United States Patent [19]

Rist et al.

[11] 4,308,941

[45] Jan. 5, 1982

[54] LOGIC FOR COIN OPERATED OFFICE COPY MACHINE VENDER

[75] Inventors: Bruno A. Rist, Woodland Hills; Michael D. D. England, Reseda, both of Calif.; Les R. Cousineau, Needham, Mass.

[73] Assignee: 501 Vendacopy, Inc., Foster City, Calif.

[21] Appl. No.: 87,842

[22] Filed: Oct. 24, 1979

[51] Int. Cl.[3] ..... G07F 17/00

[52] U.S. Cl. ..... 194/1 C; 194/9 T; 222/63; 222/64; 355/14 R; 355/15

[58] Field of Search ..... 222/63–65; 194/1 R, 1 C, 1 D, 9 R, 9 T, 10, DIG. 15; 355/14 R, 15

[56] References Cited

U.S. PATENT DOCUMENTS

| | | | |
|---|---|---|---|
| 3,632,019 | 1/1972 | Harm | 222/64 X |
| 3,848,718 | 11/1974 | Bookout | 194/10 X |
| 3,971,464 | 7/1976 | Seversen | 194/10 |
| 4,077,711 | 3/1978 | Akamatsu | 355/15 X |
| 4,084,901 | 4/1978 | Aasen et al. | 355/14 R X |
| 4,133,420 | 1/1979 | McManus | 194/9 T |
| 4,185,909 | 1/1980 | Komori et al. | 355/15 |

*Primary Examiner*—Joseph J. Rolla

*Attorney, Agent, or Firm*—Townsend and Townsend

[57] ABSTRACT

In a wet cycle copier of the small tabletop mounted variety, conversion is made for vending in the absence of frequent key operator attention. Incidence of power interruption provides for a soak cycle to occur wherein the liquid toner is cycled through the machine without drum rotation. Rotation of a glass selenium coated drum against a dried and abrading liquid applicator is avoided. After the soak cycle and assuming uninterrupted power, a cleaning cycle is initiated once every 24 hours. Assuming a lack of machine use, this cleaning cycle lubricates both toner application roller and drum to assure a wet toner applicator. Dispersant replenishment is supplied from a large volume reservoir under logic control with provision made for automated machine shutdown where dispersant on demand is not supplied. Provided modes of operation include coin vending, countermechanism vending and direct owner access vending with a tamper proof interface between the provided modes.

4 Claims, 9 Drawing Figures

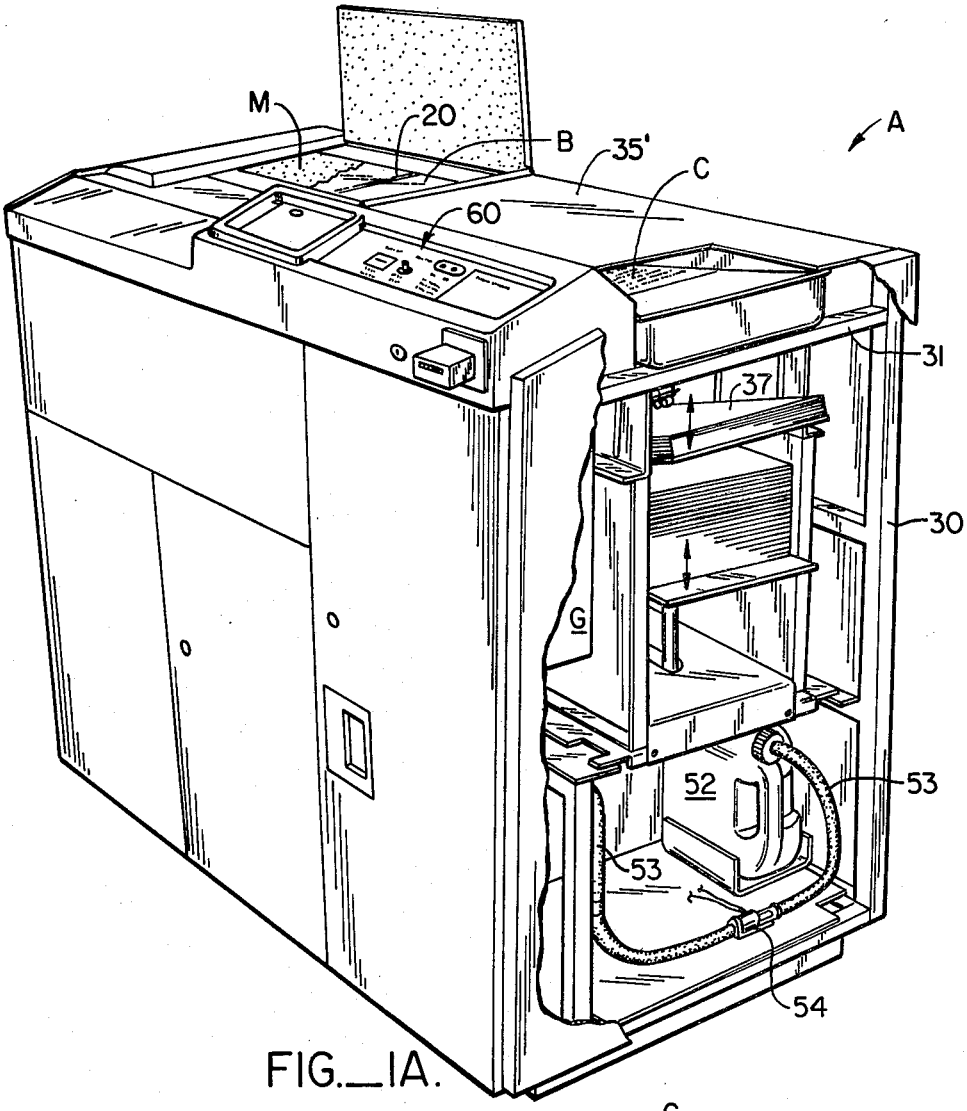
FIG._IA.
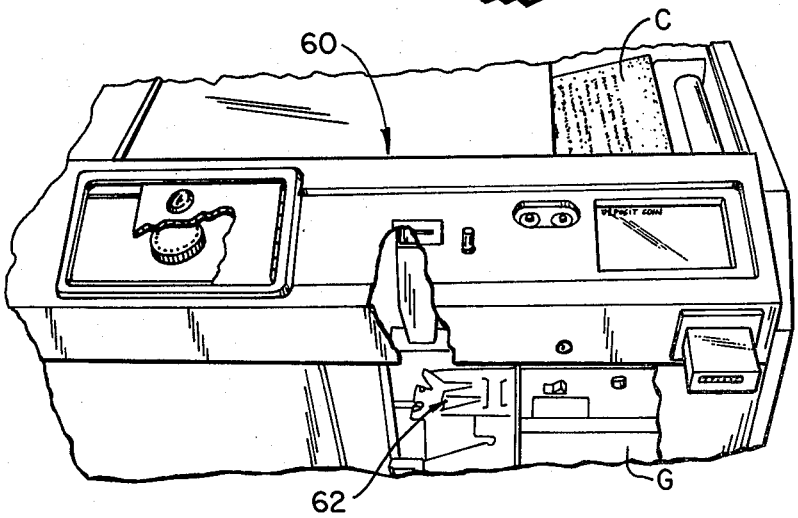
FIG._IB.

LOGIC FOR COIN OPERATED OFFICE COPY MACHINE VENDER

This invention relates to office copiers and in particular to the conversion of an office copier of the wet cycle variety to a coin vending machine.

In the preferred embodiment, the conversion of a Savin Copier 7000 office copy machine is illustrated with particularity.

SUMMARY OF THE PRIOR ART

Wet cycle copier has heretofore been preferred for their low maintenance capability. Because toner and dispersant are distributed in a liquid form, such machines are typically cleaner and provide higher copy contrast than dry copiers. At the same time, and assuming proper operator attention, maintenance costs on such machines are relatively low, especially due to the circumstance that dry toner need not be handled.

In such a copier, the paper to be copied is first registered to a glass laid out in the size of the desired reproduction. A sweeping light beam typically traversing the copy in a continuous horizontal beam vertically sweeps the paper and produces on a rotating drum a conjugate image of the paper. The rotating drum is typically glass coated with selenium. This glass is first charged at a corona and then rotated to a conjugate image made by the copier. As the image is reproduced on the drum, the charge of the drum is dissipated where light is incident and retained on those portions of the drum where light is not incident. A charge image of the copy is thus produced on the drum. Thereafter, toner/dispersant mixture consisting of electrostatically attracted pigment (toner) and a suspending fluid (dispersent) is flowed onto the drum by typically a liquid applicator roller of a sponge-like variety. Toner and dispersant adhere where charge is present leaving a pigment image on the drum. Paper to receive the imparted image is registered to the drum typically in the presence of an electric field. Transfer of the toner with some dispersent to the paper occurs. Drying of the copy followed by copy ejection results. The entire process occurs in a time period of approximately half a second.

While such wet cycle machines have had the advantage of low maintenance cost, their use heretofore in a vending copier environment has met with serious disadvantages.

Among the main disadvantages is the requirement for key operator attention to prevent dry toner casualties in the machine. Where such a wet cycle copier is not used for an extended period of time—such as a vacation period—the toner applicator roller can dry leaving deposited and abrasive toner on the roller. This abrasive toner can scar and destroy the selenium coating on the rotating drum necessitating expensive drum replacement. The necessity to keep such wet cycle copiers in a wet condition has constituted a major drawback to wet cycle copier application to the vending market where relatively long periods of machine inattention by a key operator is prevelant.

Supply of dispersant to such machine has included additional difficulties. Typically, supply of toner is made to the machine in the copier. Dispersant must be supplied from time to time to the copier in a manner wherein toner level and pigment density assures machine operation without the possibility of dry toner damage to the rotating drum. Because no provision for automated supply of dispersant from large supply reservoirs has heretofore been made, wet cycle copiers have additionally been unsuitable for the vending market.

In adaption of any copiers to the vending environment two operational precautions must be taken. First, so-called "jackpotting" or the dispersement of copies without machine remuneration, must not occur under any sequence of manipulation. Typically, a "jackpotting" sequence of manipulation rapidly becomes public knowledge or at least "goes underground" so that machine profitability is rapidly destroyed. The low margin of profitability of a vending machine may be completely destroyed.

Conversely, coins must not be taken in response to a deposit where no vend occurs. Otherwise, either machine abuse through irritated customers striking the machine or alternately bothersome calling of an on-premises attendant with ultimate requests for removal of the troublesome copier can occur.

SUMMARY OF THE INVENTION

In a wet cycle copier of the small tabletop mounted variety, conversion is made for vending in the absence of frequent key operator attention. Incidence of power interruption provides for a soak cycle to occur wherein the liquid toner is cycled through the machine without drum rotation. Rotation of a glass selenium coated drum against a dried and abrading liquid applicator is avoided. After the soak cycle and assuming uninterrupted power, a cleaning cycle is initiated once every 24 hours. Assuming lack of machine use, this cleaning cycle lubricates both toner application roller and drum to assure a wet toner applicator. Dispersant replenishment is supplied from a large volume reservoir under logic control with provision made for automated machine shutdown where dispersant on demand is not supplied. Provided modes of operation include coin vending, countermechanism vending and direct owner access vending with a tamper proof interface between the provided modes. Multiple copies are provided in the countermechanism and direct owner access modes with positive memory cancel upon where these modes are charged. Coin operation includes a system of logic controlled directives and selected flashed warning with a resultant information interface to enable virtually any unskilled operator to run the machine. This same coin vending also includes priority of events logic to prevent both the retention of a coin without the machine ready to copy and to require vending once a coin is retained. In the absence of coin, vending is prevented to destroy the relatively low profit margin of the machine. Vending of two discrete sizes of paper is provided with supervision and control logic interlocks to detect both jamming of the paper and exhaustion of paper supply with automatic indication and machine switching function to the remaining available paper supply.

Other Objects, Features and Advantages

An object of this invention is to disclose and provide an automatic soak cycle upon power application to a wet cycle office copier. With the disclosed soak cycle, the incidence of dry roller damage to the photosensitive drum is all but eliminated. In the provided cycle and upon detection of power application, power is temporarily interrupted to the rotating drum. At the same time, liquid toner and dispersant is pumped to fully lubricate and dissolve solidified toner on the applicator roll. After a prolonged soaking, cycling of the machine including restored drum rotation can resume.

According to another aspect disclosed soak cycle of the copier, and assuming continuous power, operation of the machine to a cleaning cycle is activated every 24 hours. In such a cleaning cycle, drum rotation with toner application occurs. By repeating this cycle on an automated basis once every 24 hours, maintenance of the roller applicator in a wet and non-abrading state is assured.

An advantage of this aspect of the invention is that the wet cycle copier can be adapted to virtually any vending environment. So long as adequate liquid dispersant is present, rotation of the delicate selenium coated drum in a wet environment only is assured.

A further advantage of this invention is that machine disconnection from a power supply—such as occurs with surprising regularity in many vending environments—is no longer a requirement for a key operator to service the machine. Instead, upon the restoration of power, the precautionary soak cycle immediately occurs.

According to another object of this invention, provision is made in the disclosed machine for the dispensing of liquid dispersant to the copier ready reservoir with automated machine shutdown in the absence of liquid dispersant being supplied. According to this aspect of the invention, and in response to a prior art toner/dispersant level detector in the copier, dispersant is pumped by a positive displacement pump from a relatively large reservoir. Dispersant is supplied until the reservoir is full. When the reservoir is full, pumping ceases. Dispersant can be supplied for a preselected "normal" period of time only. If this time interval is exceeded, pump operation remotely ceases. In the event of a failure to deliver the requested dispersant and toner within the disclosed "normal" period of time, machine misfeed is generated with restarting of the copier inhibited until operator attention occurs.

An advantage of this aspect of the invention is that the dispersent dispensing cycle here provided in combination with the soaking and cleaning cycle renders starting of the machine in the absence of a lubricated roller virtually not possible. As a consequence there is provided a wet cycle office copier machine which can survive in virtually any vending environment.

A further object of this machine is to provide a coin vending copier which readily converts to an office copier. Conversion to an office copier is provided by either countermechanism copier access mode or alternately proprietor direct bypass mode. Both countermechanism mode or direct bypass mode have provision for multiple copy production. Provision is made to positively deactivate the multiple copy memory upon switching between copier modes to prevent multiple copy vending upon a coin vend or when the countermechanism is withdrawn.

An advantage of this aspect of the invention is that the multiple copy memory of the machine can be preserved for owner and countermechanism holders. At the same time, the counter deactivating circuit assures vending only in response to a compensating coin deposit or accumulating countermechanism count. A "fool proof" switching between the provided modes of copier count results.

A further object of this invention is to assure that coin retention only occurs when the machine is ready to copy and vending not only occurs but is compelled in response to a compensating coin deposit. According to this aspect of the invention, both a visual display and coin chute are interconnected to priority of events machine logic so that coins are only accepted when and if the machine is in readiness to vend. Where either machine cycle or cleaning or soaking or alternately paper jamming, the lack of liquid toner, or the unavailability of paper is present, coin deposit will not be retained. Where machine readiness permits coin deposit, a machine memory is activated for an indefinite period of time. During this period, the machine will not accept coin deposit and actively indicates through a display that copy may be produced. Machine events that can cause optional shut down, such as insufficient toner pigment, are inhibited from causing machine shut down until the called for vend occurs.

An advantage of this aspect of the invention is that vender may operate on a low margin of profit. Incidence of machine "jackpotting" or production of copies without compensating deposit are virtually eliminated.

A further advantage of this aspect of the invention is that customer demand on the machine for return of coin without a corresponding copying vend is eliminated. Incidence of attendants being called upon to reimburse customer or alternately pummeling and damaging of a vending machine can be held to a minimum.

A further advantage of the disclosed circuitry is human engineered with a series of informational directives and/or flashing warning directives to provide an informational interface to enable virtually any unskilled operator to operate the copier. According to this aspect, and upon completion of any preparatory soaking or cleaning cycles, a display indicates machine readiness for the deposit of coin. Upon receiving compensating coin deposit, copy size designation is requested. With appropriate registry of the master to the glass and measure at the glass of the copy size needed, vending can occur only by deliberate and prolonged contact to an electrode (operator touch plate) which simultaneously designates the copy size as well as initiating the copy cycle. A copy in response to the deliberate and prolonged vend request is reproduced.

An advantage of this aspect of the invention is that copy size is not designated prior to coin deposit. Where this prior designation occurs, a coin customer can designate the wrong copy size before registry of the master to the copier optical interface occurs. For example, designation of an 11 inch copy, where registry of the 14 inch master demonstrates that the larger size is required does not occur.

A further advantage of this invention is that simultaneous designation or near simultaneous designation of both copier sizes prevents a machine vend. Operator error in designating copy size is reduced.

A further aspect of this invention is to adapt an electrical interface to read the status of an enlarged paper dispensing magazine of the multicopy size variety to indicate malfunction both in the exhaustion of paper supply or improper sheet feed. According to this aspect of the invention, there is provided a combination of a microswitch and a feed timing motor. Where either the microswitch is closed indicating the absence of paper in the magazine or alternately running of the feed machanism for a prolonged period of time without the copier seeing supplied paper for copying, non-availability of the selected copy size is immediately indicated and thereafter displayed. The select button for the indicated unavailable size is deactivated. This display of paper size availability remains indicated throughout subsequent vends until paper resupply or clearing of a paper feed jam results.

The advantage of this aspect of the invention is that inoperability of one magazine does not require shutdown of the entire machine typically through indication of a misfeed. Instead, vending continues to occur until both paper magazines are exhausted. Vending can occur until all available paper is exhausted.

A further advantage of the display is that the status of the copier as to the available paper size is immediately indicated through the display when the paper supply of either paper size is exhausted.

Other objects, features and advantages of the disclosed invention will become more apparent after referring to the following specification and attached drawings in which:

FIGS. 1A–1C are respective machine exterior views illustrating the adaptation of a Savin 7000 wet cycle desktop copier to a vending function with the respective drawings illustrating in FIG. 1A the machine frame with copier support, large magazine, and large dispersant reservoir and pump all specifically shown.

FIG. 1B is a sectional view illustrating the coin deposit and direct owner-access portions of the machine; and FIG. 1C illustrates the machine copier in section—broken away—for illustration of the key portions of the machine;

Figure 1C:
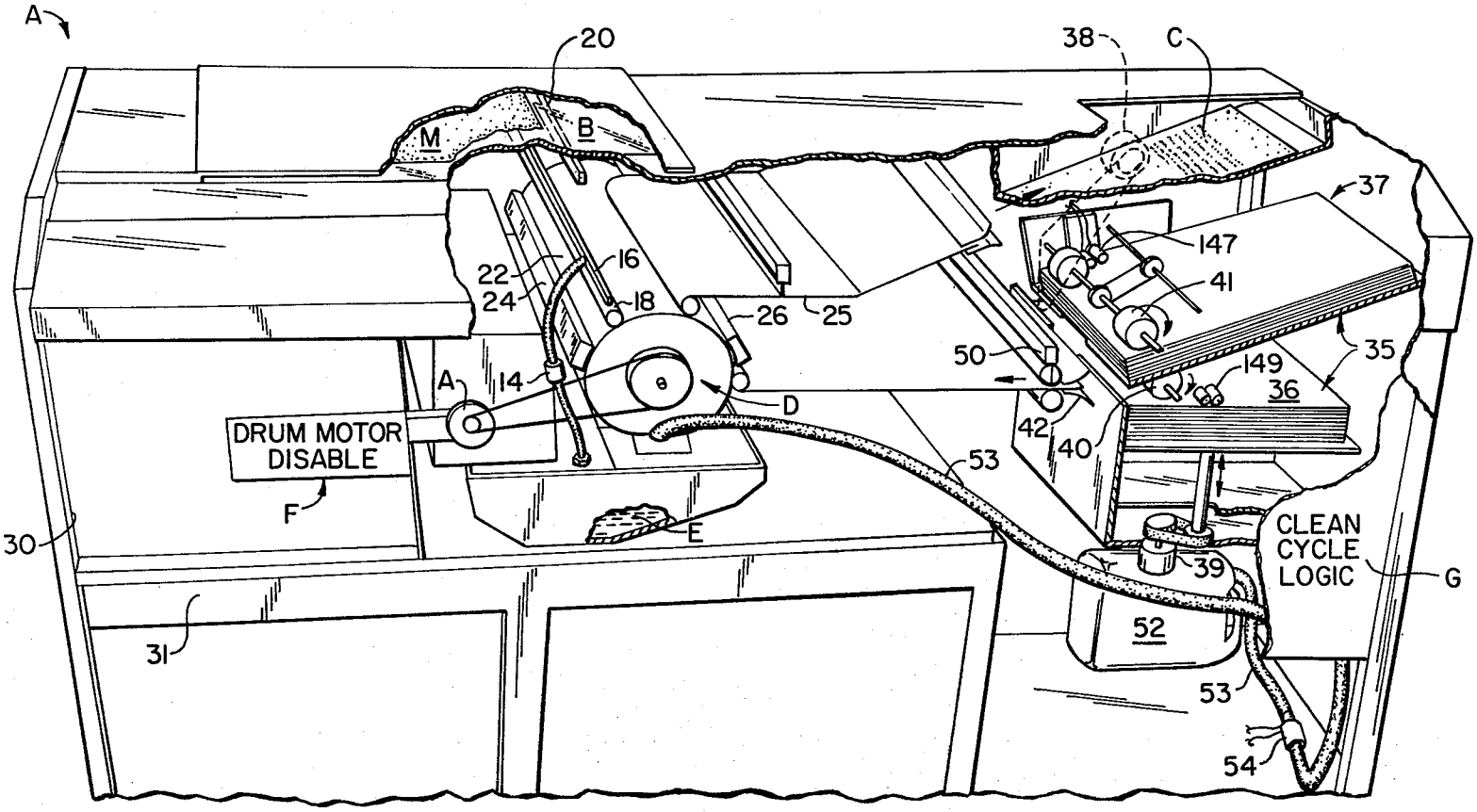

In order to explain this invention, reference to the schematic of FIGS. 1A–1C of the copier will be set forth. Thereafter, and with reference to FIGS. 2–7, the electronic logic of this invention will be set forth.

With reference to FIG. 1A, a copy machine A is illustrated having a master M being registered to a glass plate B. As in conventional copy machines, copy C is ejected from the machine.

Referring to FIG. 1C, interiorly of the machine there is a selenium coated glass drum D. It is this drum D which causes the gravest difficulty in a vending environment. The standard office copier which is the subject of the conversion of this invention includes a liquid toner reservoir E and a pump 14 which through a manifold 16 applies liquid toner to a sponge roller 18. Sponge roller 18 when in the dry state can cause the abrasion of the delicate selenium surface of drum D. Should rotation of drum D occur when roller 18 has toner with solidified pigment thereon, abrasion and inoperability of the drum D can rapidly result.

Operation of the copier will only be briefly set forth. Typically, master M is scanned by a light 20 and produces on drum D at location 22 a conjugate optical image. Drum 22 rotates and is first electrically charged at a corona 24. Since the incidence of light causes photoelectric discharge and non-incidence of light maintains the charge on the drum, an electric image of master M is produced on the drum as it rotates from the point where the conjugate optical image is produced.

This electric image passes to and under the toner application sponge roll 18. Pigment is attracted to the charge portions with the result that the toner pigment then forms on the drum an image of the master M. Thereafter, paper 25 passes between the drum D and a corona device 26 to impart an image of the master M. The paper when ejected from the machine comes out in the form of copy C which is preferably an image replication of the image on the master M.

The copy machine here illustrated is a Savin 7000, a product of the Savin Copier Company of Los Angeles, Calif. It will be understood that any wet cycle copier can be utilized with this invention. However, the conversion of the Savin is the preferred embodiment of this invention.

Having set forth the schematic of the Savin, attention will now be directed to those added features illustrated in FIGS. 1A–1C which are part of the vending conversion of this invention.

Typically, the Savin copier is a desk mounted model. It is mounted to a frame A and provided with an overall decorative housing 35'. Decorative housing is a subject of Design Patent Application Ser. No. 918,434, filed June 23, 1978, entitled "Copier", by T. Douglas Lawrence, now abandoned.

Interiorly, the machine A includes a frame 30, a support 31 is generally defined for receiving the copier.

The end of the copier is modified. Towards the end of the copier, there is provided a dual paper tray 35. This tray includes a lower paper magazine 36 (for eleven inch copy paper) and an upper paper magazine 37 (for fourteen inch copy paper). A motor 38 controls through a chain drive respective cats tongue rollers 40 and 41. Through provided mechanical linkages, the respective cats tongue rollers feed paper towards a feed chute 42 on the copier.

Upper magazine 37 is sprung on a system of negatory springs (not shown) so that the stack of paper maintains the proper elevation and pressure against the rollers for the feed of paper. Typically, this stack of paper is of a longer length—14 inches in length—than the lower paper magazine 36. However, the amount of paper stored is less, there being 250 sheets of 14 inch paper and 750 sheets of 11 inch paper.

Lower magazine 36 is provided with an elevator motor 39 which drives an elevator screw upwardly and downwardly upon command.

In order to dispense paper, motor 38 preferably rotates in one direction or the other. Rotation in the first direction releases a clutch on one magazine causing no movement of the applicable cats tongue roller and at the other paper magazine causes rotation of the cats tongue roller. Dependent upon the magazine selected, paper advances from the magazine 35 to and towards the open paper chute 42. At chute 42, a microswitch 50 is contacted. As will hereinafter be more fully set forth, upon microswitch 50 being activated, all movement of motor 38 ceases. Thereafter, drive rollers interior of the copier take over the movement of the paper in a conventional copying cycle.

Aside from the paper feed, other major alterations are made to the copier. These are respectively, the enlarged toner reservoir 52, the drum motor disabled control F and the interruption to the cleaning cycle logic G.

A large quantity of toner typically provided in a two-gallon bottle 52 has disposed therein a suction line 53 from a pump 54. Discharge of the pump is to the ready toner reservoir E through a conduit 53.

As will hereinafter be stressed, when art mechanisms interior of the copier sense the need for additional toner/dispersant to the toner ready reservoir E, pump 54 is actuated and held on line until the toner/dispersant reservoir indicates that it is full. At the end of this cycle, one of two states will result. Preferably, sufficient toner will be provided so that the ready reservoir E no longer calls for toner. Alternately, and in case of either the malfunction of pump 54 or the exhaustion of the supply of toner in bottle 52, the pump will run until timed out. Thereafter, the pump will cease to operate and the logic will indicate "SOLD OUT". The circuitry function to allow this result will hereafter be set forth.

Copiers A such as the preferred Savin Model 7000 are provided with a cleaning cycle. This cleaning cycle actuates whenever the machine is in the off state and is called upon to produce a copy. For example, where more than a sixty second interval occurs since the machine has reproduced a copy, the machine will switch to the "off state". Thereafter when called upon to produce copy, the cleaning cycle will be initiated. During the cleaning cycle, drum D is rotated by motor 60 while pump 14 and manifold 16 distributes toner and dispersant to roller 18.

It will be understood that the duration of the cleaning cycle can vary. The circuit used on the Savin copier includes a discharging capacitor which increases cycle length in inverse proportion to the charge on a charged capacitor. The capacitor is provided with a high resistance path to ground so that with increasing interval from the last time the copier is in the off state, length of the cleaning cycle likewise increases.

In order to accomplish the soak cycle of this invention, two modifications to the operation of the Savin copier must be made. First, provision must be made to disable the drum motor. This is schematically illustrated at F on FIG. 1C and will be more thoroughly hereafter explained with respect to solid state relays or preferably optoisolators.

Secondly, it is necessary to provide and interrupt the cleaning cycle logic of the Savin copier. This interruption delays the start of the cleaning cycle to and until the soak cycle of this invention is completed.

To accomplish the vending function of this invention, a state of the art coin receipt mechanism 60 is provided (see FIG. 1B). This mechanism includes provisions to prevent coin retention at relay 62. A coin receipt unit suitable for this invention is COINCO Model S75-9800A, Coin Changer manufactured by COINCO of St. Louis, Missouri.

Having set forth the schematic of the copier and FIG. 1, attention will now be devoted to the circuitries illustrated in FIGS. 2–7.

Figure 2:
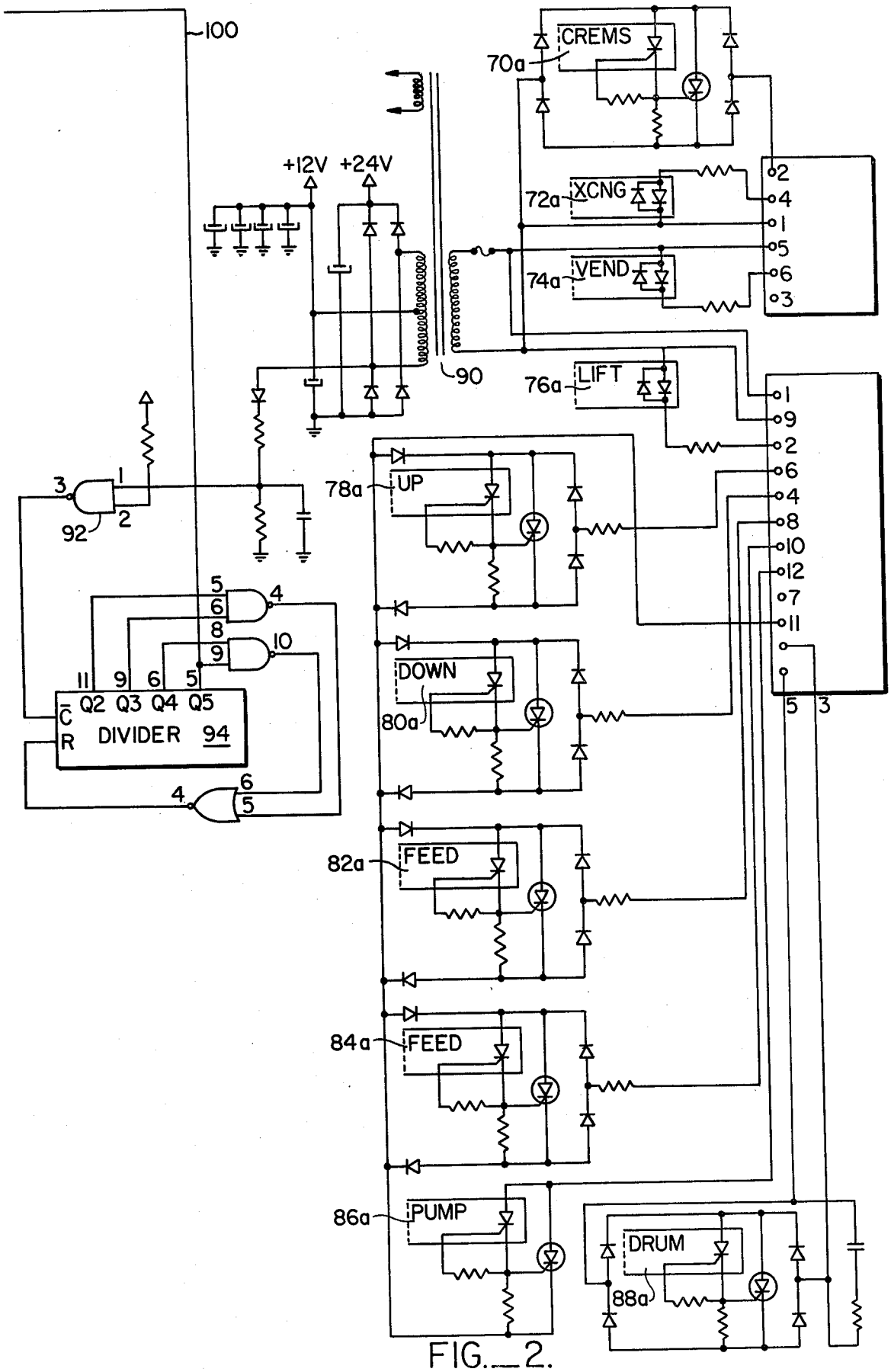
FIGS. 2–6 are a right to left series of drawings which when laid side by side right to left form a complete circuit schematic of the copier logic; and, FIG. 7 is a schematic of the display circuitry and push button mechanisms.

Referring to FIG. 2, the 120 volt 60 Hertz connections of this invention are schematically illustrated. Coin mechanism 60 is provided with an electromagnetic relay 62. In the activated position, the relay is engaged so that the coin mechanism may accept coin. In the unactivated position, relay 62 prevents coin retention. Activation of a relay is made through an optoisolator 70A in FIG. 2 to the 120 volt side of the line. At FIG. 6, the logic connected portion of the optoisolator 70B is illustrated.

Figure 6:
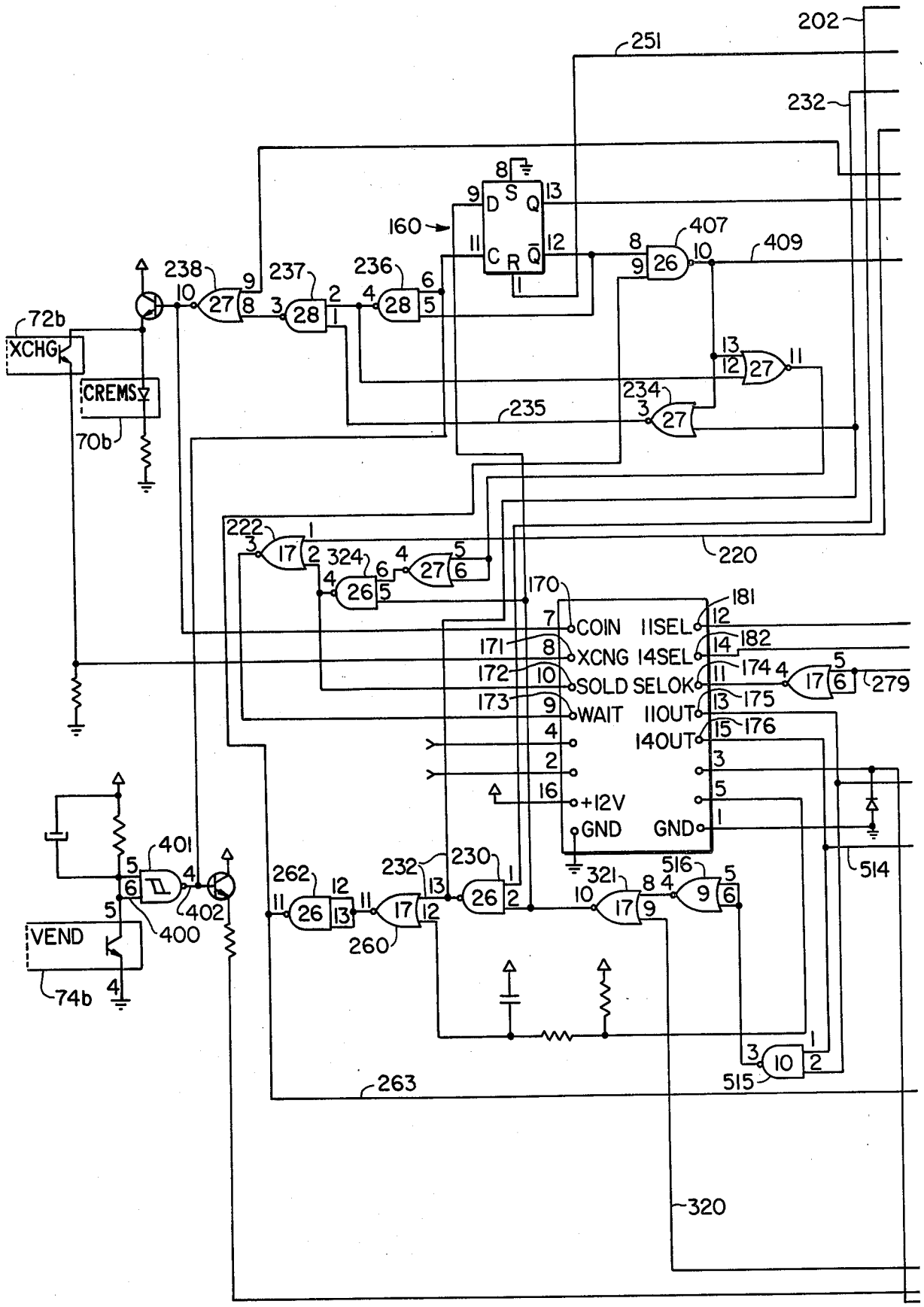

Similarly, the coin mechanism is provided with an exact change output (not shown). Exact change output is connected on the 120 volt line side by optoisolator 72A. Referring to FIG. 6, the exact change optoisolator 72B is shown connected to circuit logic. The exact change output indicates that the coin mechanism does not have sufficient coin to reliably make change.

A vend signal is provided on the 120 cycle side through an optoisolator 74A. At FIG. 6, the logic connected segment of the optoisolators 74B is illustrated.

Figure 5:
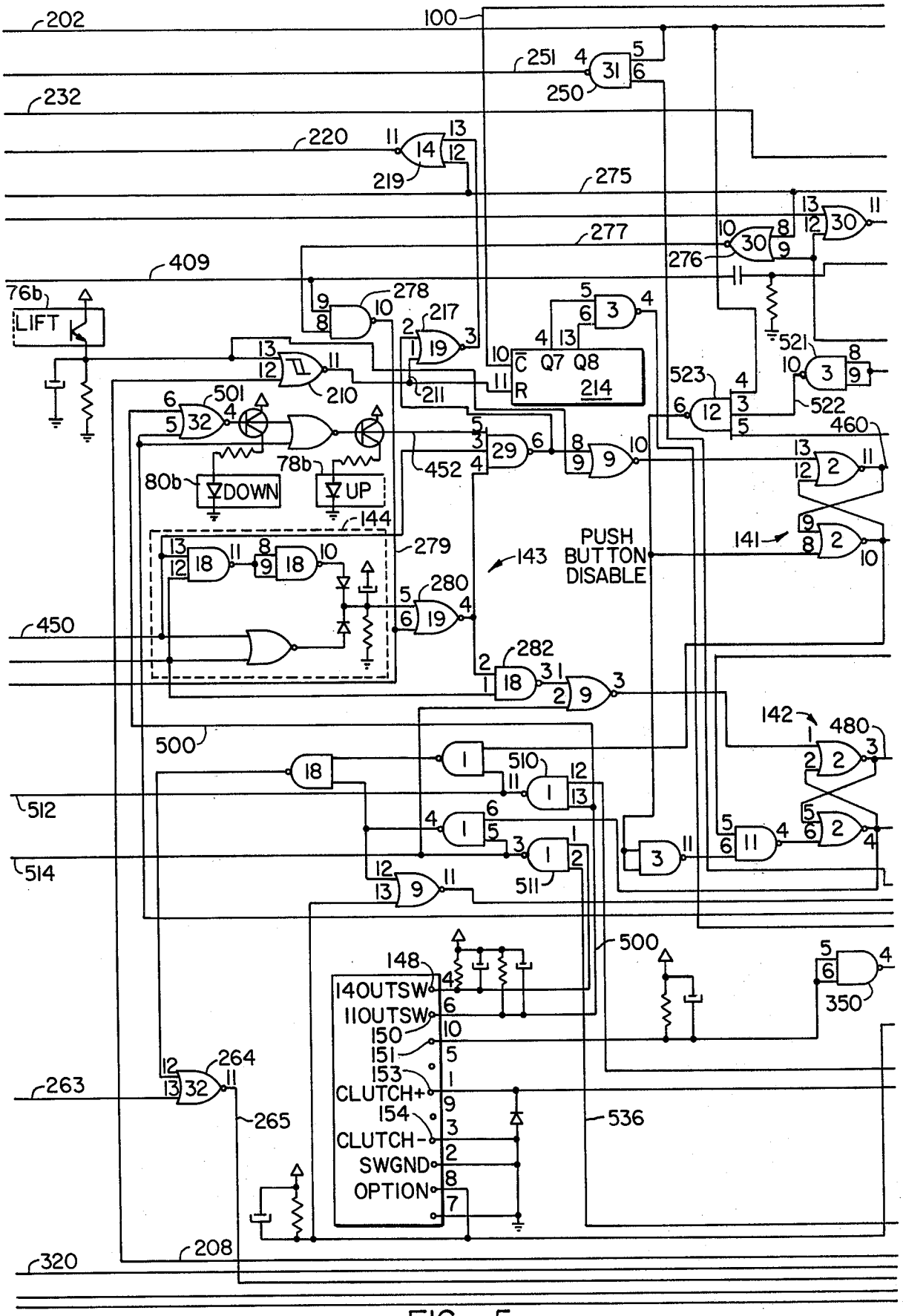

In order to aid operation of the copier in a vending format, an expanded paper feeding magazine and pump is provided. Movement of the lift to magazine 36 is enabled through an optoisolator 76A on the 120 volt side. Referring to FIG. 5, the optoisolator section 76B connected to the logic is illustrated.

Figure 4:
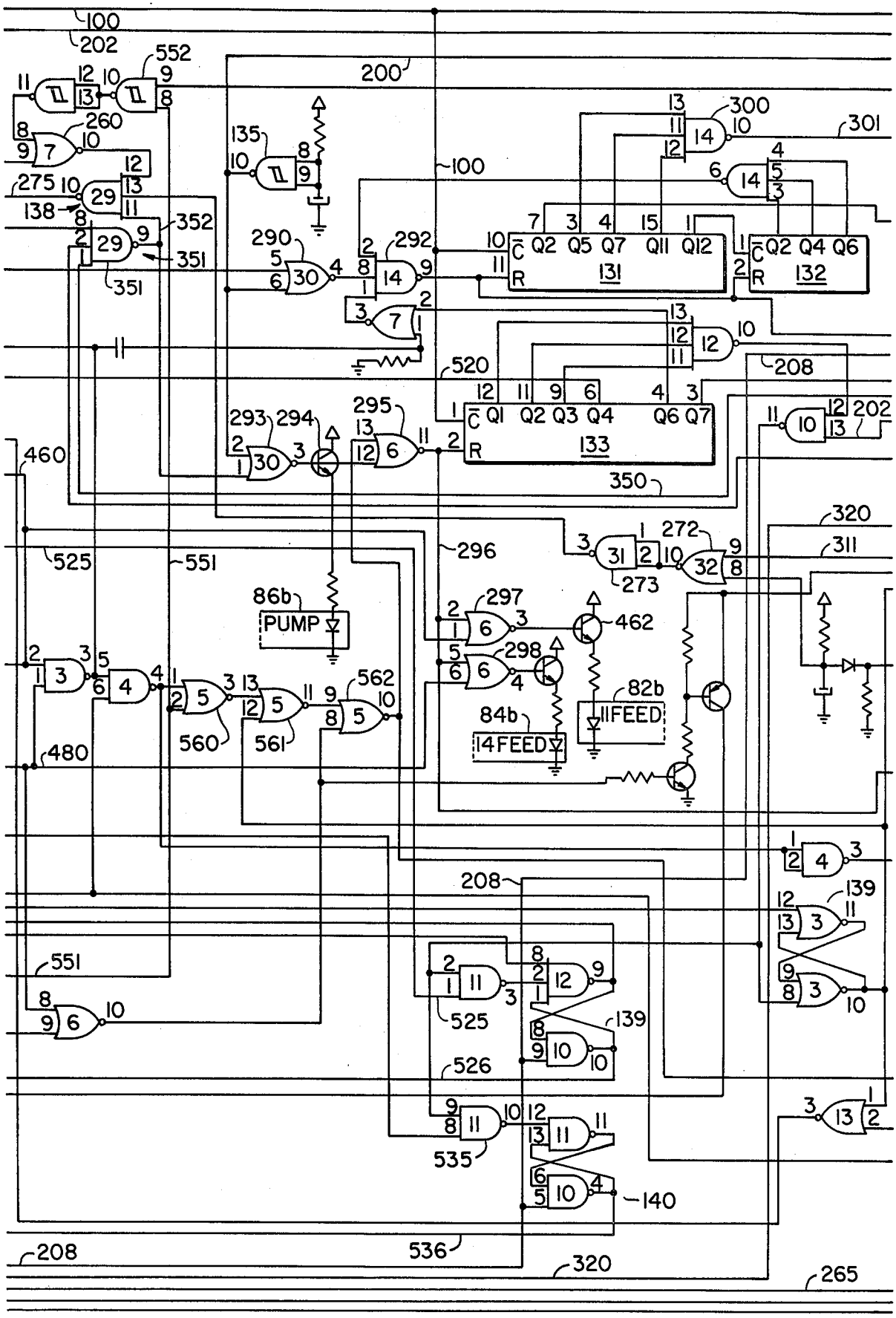

Lift direction is chosen by up optoisolator 78A and down optoisolator 80A. Referring to FIG. 5, the logic connected optoisolator portions 78B (up optoisolator) and 80B (down optoisolator) are illustrated. The respective feeds enabling rotation of motor 38 in one or the other direction to feed 11 or 14 inch paper are enabled at the 120 volt side by optoisolators 82A (11 inch feed) and optoisolator 84A (14 inch feed). Referring to FIG. 4, the logic connected optoisolator portions 82B (11 inch feed) and 84B (14 inch feed) are illustrated.

Pump 54 for supplying toner to ready reservoir E is actuated on the 120 volt line side by optoisolator 86A. Referring to FIG. 4, the logic connected side of the optoisolator is shown at 86B.

Figure 3:
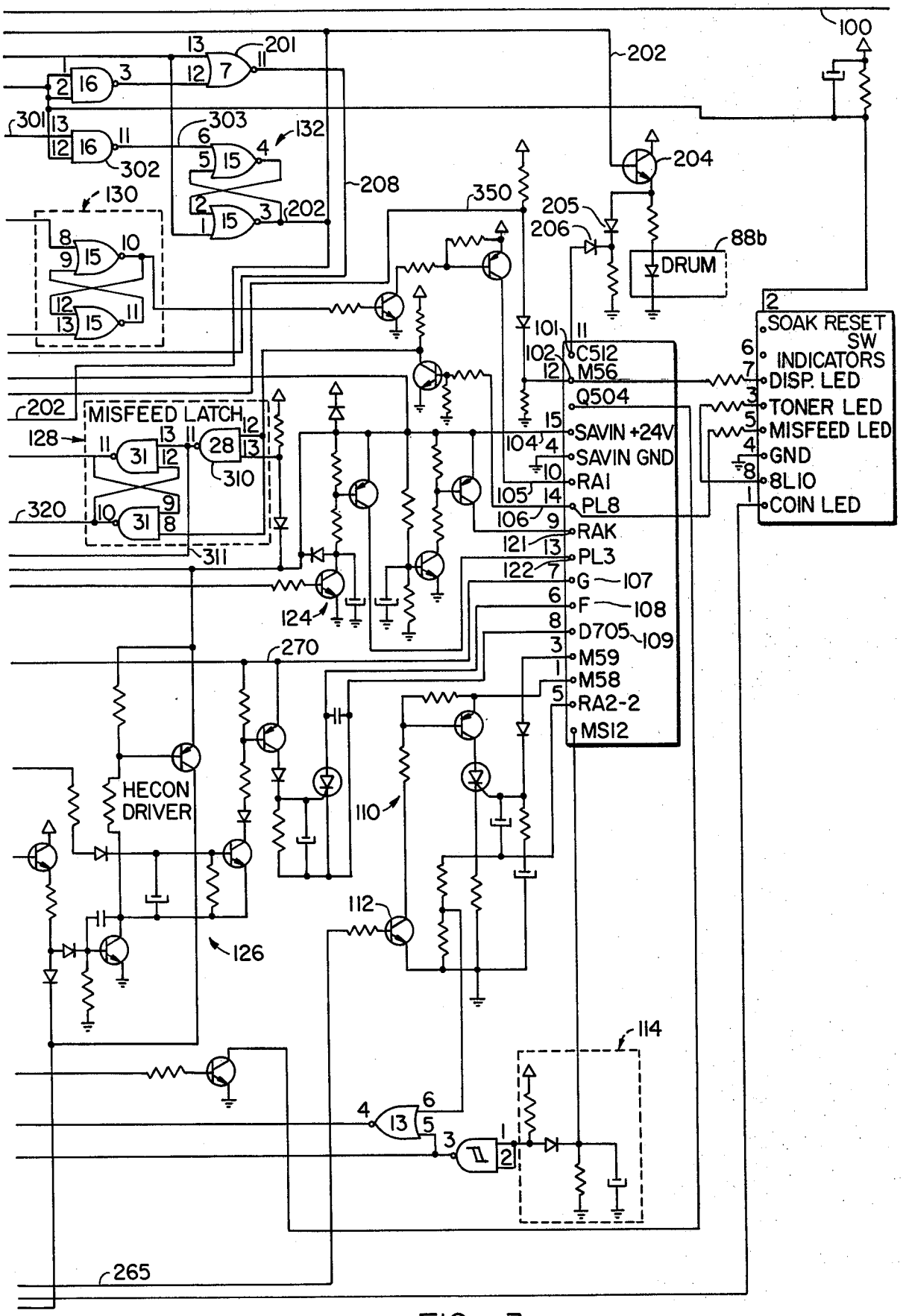

In order to enable the soak cycle which is an important part of the disclosure herein, disabling optoisolator 88A is connected to the 120 volt line side. Referring to FIG. 3, the logic connected portion of the optoisolator is illustrated at 88B.

Now referring to FIG. 2, logic here illustrated is a 12 volt CMOS logic system which is powered from the secondary winding of a transformer 90. A 60 Hz signal is obtained at transformer 90 and shaped through standard circuitry and passed through a Schmidt triggered nand gate 92 to a 30 times divider 94. The divider is gated at suitable gates to have a two hertz (hereinafter Hz) output to and through a clockline generally denominated 100.

This clockline becomes the time base for the clock logic herein illustrated.

Having set forth the essential 120 volt circuitry and clock of this invention, attention will now be devoted to describing in major logic sections the logic respectively of FIGS. 3, 4, 5, 6 and 7. Thereafter, exemplary logic steps will be set forth, with particular attention to the novel functions of the vending version of this invention.

The logic function of the preferred embodiment of the copier of this invention includes 24 volt logic functions. These respective logic functions are usually broken down to the 12 volt level by applicable transition circuitry where required. Specific connections to the Savin logic are illustrated in FIG. 3, and include a connection 101 which functions to hold off the Savin cleaning cycle previously described. A connection 102 provides a high electrical signal upon the sensing of a low level in the ready dispersed reservoir E. The copier 24 volt B+ line connects at 104 with the copier main power relay provided at 105. With activation of the relay, and in the absence of the soak cycle of this invention, power applied to connection 105 will activate the copier.

Typically, the copier is provided with misfeed detecting circuitry. This circuitry detects either jamming paper interior of the machine or alternatively overlong illumination of the copier light—an intense high heat bulb. Connection to this circuitry is provided at 106.

When the Savin machine itself is ready to copy, a high signal is provided at circuit 107. This signal is utilized for various logic states illustrated hereafter.

Commencement of a copier cycle is provided by closing circuits 108, 109.

Standard multiple copy circuitry 110 is provided for the initiation of multiple copies. As will hereinafter become more apparent, disabling transistor 112 is utilized to disconnect this circuit upon a coin vend.

Finally, there is provided a delay circuit 114. The purpose of delay circuit 114 is to sense passage of a copy through the machine through a preselected point wherein further passage can occur without interference by a newly initiated copy cycle.

Where a copy cycle is commenced and it cannot be completed because of the unavailability of paper or the like, it may be necessary with certain paper supply mechanisms to abort the copier cycle. Cycle abortion is provided at input terminals 121, 122 which are in turn activated through circuitry 124 (see FIG. 3) and an abort cycle latch 139 (see FIG. 4).

It is sometimes desired to operate the machine with a countermechanism such as a Hecon driver. Circuitry for activating a hecon driver is illustrated at 126 (see FIG. 3).

Referring to FIG. 3, in the circuitry hereinafter analyzed, it is important that a copier misfeed be remembered in a nonvolatile fashion. Accordingly, there is provided misfeed latch 128.

Misfeed latch 128 has two discrete functions. First, when a misfeed occurs, an electromechanical relay interior of the copier is thrown and latch 128 detects the mechanical position of this latch. Misfeed latch 128 thus informs the vend circuitry of the existent misfeed state interior of the copier.

Second, and assuming power has been disconnected with the electro-mechanical relay interior of the copier in the misfeed state, misfeed latch 128 interrogates the electromechanical latch for position. If the position indicates misfeed, the misfeed state is immediately communicated to the disclosed vending logic. In this way a "non-volatile" indication of misfeed is provided to the disclosed vending logic.

Continuing on FIG. 3, starting of the copier initially to cycle is provided by a start latch 130. As will hereinafter be apparent, upon the initiation of power, latch 130 will through the main power relay 105 effect start up of the copier.

Finally, with respect to FIG. 3 there is provided a soak cycle latch. This latch 132 includes logic necessary to initiate the soak cycle when power is first applied to the unit herein.

The major component parts of FIG. 4 include clock or divider circuits 131, 132. These dividers 131, 132 time the soak cycle, and initiates starting of the copier. Additionally timers 131, 132 combine to form a 24 hour clock which initiates a single cleaning cycle every time the machine is not used for a 24 hour period.

Timers 131, 132 reset upon each incidence of start up power. Additionally reset occurs where either a vend occurs or a copy size is called for. Moreover, when a cleaning cycle is called for at the end of a 24 hour period, reset of timers 131, 132 likewise occurs.

A third divider 133 times the period of time the pump is on (32 seconds) and additionally provides a time for the abort cycle (3.5 seconds) and the feed cycle (3.5 seconds). It will be remembered that with respect to the feed cycle should the paper feed motors run for a period of time exceeding 3.5 seconds, a malfunction of the feed mechanism will be initiated by this timer. This timer resets upon each incidence of start up power.

When power is initially supplied to the machine, this power is sensed at a power-up reset 135. Power-up reset 135 reads the main a.c. line and initiates the soak cycle sequence of this invention.

Central to the logic of this system there is provided a wait gate 138. This gate initiates through a low output a ready to receive coin signal. It includes discrete outputs top to bottom which permit the deposit of a coin, indicates that the copier is ready to copy, and indicate that the dispersent pump 54 is not transferring dispersent from reservoir 52 to the dispersent ready reservoir E.

At the bottom of FIG. 4, are two fault latches 139, 140. Eleven inch faults latch 139 indicates a failure of the 11 inch feed magazine 36 to supply paper to the copier. Additionally, and for 11 inch size paper only, where the lift motor runs for over a preselected period of time without paper being "seen" by the feed mechanism, eleven inch fault latch 139 will be activated. Fourteen inch faults latch 140 indicates a similar failure of magazine 37 to deliver paper to the copier.

Referring to FIG. 5, paired latches 141, 142 are utilized for initiating the respective start 11 inch copy (latch 141) and start 14 inch copy (latch 142). Both of these respective latches are activated through discrete legs of the push button disable circuitry 143.

As will hereinafter be more fully set forth, it is desirable to prevent an accidental digit contact to the actuation button for copying either copy size from initiating a copy cycle. Accordingly, a debounce and select lockout (exclusive OR) circuitry 144 is utilized. Circuitry 144 requires a finite and deliberate contact of the digit to activate the copy cycle of this invention. For example, deliberate finger contact in an order of time exceeding half a second is required before a copy will issue.

Each of the magazines is provided with microswitches to indicate when the magazines are out of paper. A microswitch 147 (see FIG. 1) indicates through connection 148 when the 14 inch paper supply is exhausted. Likewise, a microswitch 149 (see FIG. 1) indicates through the terminal 150 when 11 inch paper is exhausted.

It will be remembered, that when paper is introduced interiorly of chute 42, a microswitch 50 sees the paper. This microswitch has an output 151. Output 151 goes low upon a paper being seen by microswitch 50.

It may be desired to provide clutches instead of the reversible motor drive indicated at motor 38 in magazine 35. This being the case, provision is made for clutch connections.

Referring to FIG. 6, vend latch 160 functions to remember when a vend signal is issued. This latch preserves the machine in a ready to copy state for an indefinite length of time until a paper size has been selected and the copy cycle completed. The latch is a positive edge triggered Type D flip-flop which only sets when vend occurs.

A positive edge triggered type D flip-flop sample the logic level at the D (data) input when the clock input goes from low to high, and causes the Q output of the flip-flop to agree with the sampled D input (the $\overline{Q}$ is the inverse of Q).

Figure 7:
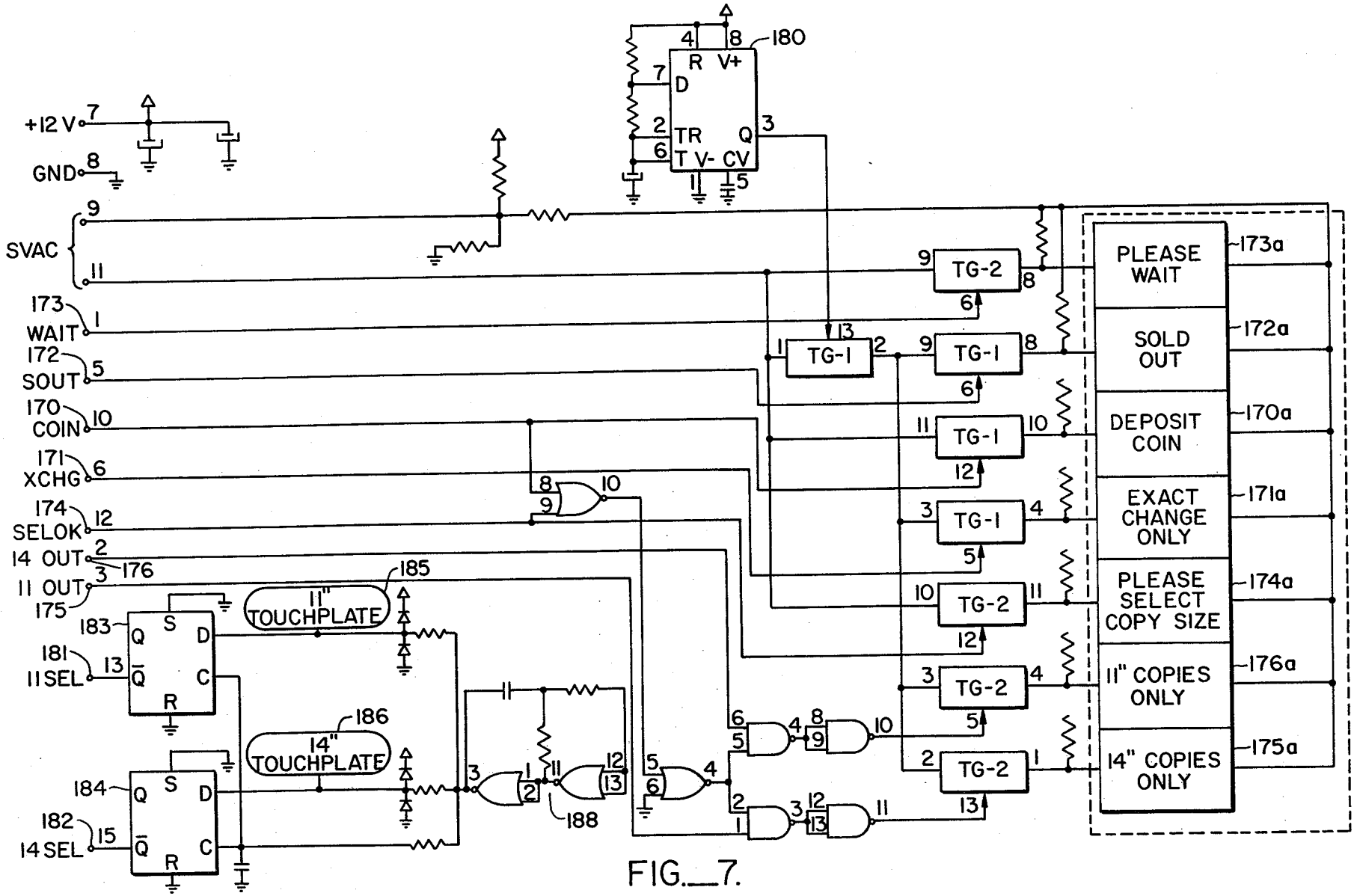

Referring simultaneously to FIGS. 6 and 7, circuitry is illustrated for the directive display of this mention. A "Deposit Coin" terminal is indicated at 170 (see FIG. 6) and actuates in FIG. 7 a deposit coin display 170A. An "Exact Change Only" terminal 171 displays an exact change only signal 171A. Terminal 172 is a sold out terminal and initiates "Sold Out" display 172A. A "Please Wait Machine in Cycle" terminal 173 initiates a sign at 173A. A "Select Copy Size" terminal 174 initiates a display 174A. Respective terminals 175, 176 activate displays 175A ("14 Inch Copies Only") and 176A ("11 Inch Copies Only").

Referring to FIG. 7 in detail, circuitry 180 initiates a flashing signal. Connection is provided to the respective displays 172A ("Sold Out") 171A ("Exact Change Only") 176A ("11 Inch Copies Only") and 175A ("14 Inch Copies Only"). It has been found that by flashing these respective displays, greater customer awareness is provided.

Selection of the desired copy size is made through selector switches 181 (11 inch selection) and 182 (14 inch selection), see FIGS. 6 and 7. Referring to FIG. 7, it will be seen that these leads connect two paired positive edge-triggered flip-flops 183, 184. These respective positive edge-triggered flip-flops are provided with a signal form oscillation circuitry 188 which in the absence of additional capacitance being added to the respective touch plates 185, 186 cause the flip-flops to be set. Upon added capacitance and/or resistance to ground at either of the touch plates 185, 186, by the capacitance and/or resistance of an object, preferably the human body, a delay occurs in one of the oscillator signals to the flip-flop. This delay allows the flip-flops 183, 184 to be cleared and causes a positive going signal out the respective terminals 181, 182.

It should be mentioned, that the copy size selection circuitry here illustrated has the advantage of eliminating moving parts from the copier activation circuitry. Instead, a single electric terminal communicated deliberately to the hand is sufficient to initiate the copy cycle herein described.

Having described in a general fashion the overall key portions of the circuitry, attention can now be devoted to the actual function of the disclosed logic. In this disclosed logic, machine start-up will first be described.

With reference to FIG. 4, it will be remembered that when the machine is first applied to the power, this is the time that roller 18 stands in danger of damaging the selenium rotating drum D. This being the case, the soak cycle of this invention needs to be initiated. In the soak cycle, lubrication of the roller 18 will occur all without rotation of the drum D.

Referring to FIG. 4, when power comes up, a Schmidt triggered nand 135 connected to resistance/-capacitance network will initiate a high pulse through lead 200 to nor gate 201 (see FIG. 3). Likewise, latch 132 will receive a high pulse. The latch will output at terminal 202 a low.

The low will cause npn transistor 204 to turn off the LED in optoisolator 88B. Consequently, and through the circuitry of 88A the drum motor will be disabled.

At the same time, it is desirable to disable and delay the actuation of the cleaning cycle. Referring to FIG. 3, when transistor 204 is on, diode 206 is reverse biased. Normal cleaning cycle and drum rotation will occur.

Where however, transistor 204 is off, drum operation will be inhibited at opto-isolator **88*b*. At the same time, reverse bias through diode 205 to diode 206 will be removed. Cleaning cycle timer at terminal 101** will be inhibited.

It should be apparent that when transistor 204 is again turned on, the diode 206 again will be reverse biased, terminal 101 will remain high and the cleaning cycle may recommence.

The low produced at gate 201 (see FIG. 3) will cause through line 208 resetting on the 11 inch fault latch, 139 and the 14 fault latch, 140 (see FIG. 4). Finally, and at line 208, and through Schmidt nand gate 210 (see FIG. 5) a high at line 211 will reset lift time out 214. Lift time out 214 is the divider which times the period during which the elevator motor 39 on magazine 36 may raise and lower the paper dispensing tray.

Continuing on at FIG. 5, the high at 211 through nor gate 217 a logical low at line 218 continues through nor gate 219 at line 220 to nor gate 222 (see FIG. 6). At nor gate 222 the low on both nor gate inputs converts to a high and illuminates the sign "Please Wait, Machine in Cycle" at terminal 173 through the logic set forth in FIG. 7.

Returning to FIG. 3, the low produced at output 202 will function to disable the coin receiving mechanism (CREMS) relay 62 from receiving change. Specifically, line 202 with its low from soak cycle latch 132 will pass to nand gate 230 (see FIG. 6) and generate across the gate a high at outputs 232. This high will pass through nor gate 234 producing a high on line 235. This high will pass through nand gate 236 nor gate 237 which will go low. In going low, voltage will be blocked through npn transistor 238 extinguishing enabling light emitting diodes 70B and preventing the exact change signal from being displayed at optoisolator 72B.

It is necessary that the restoration of power restore and reset the vend latch 160. Remembering the low on line 202 produced by the soak cycle latch, it will be seen on line 202 at FIG. 5 that nand gate 250 converts this load to a high at reset output 251. Reset output 251 resets vend latch 160 to the "owe me" state.

At the same time the machine is started up, it is necessary to disable the memory for multiple copies. Accordingly, in remembering that the output of nand gate 230 was a high on line 232 (see FIG. 6), this high produced a low through nor gate 260 and a high through nand gate 262 which is here shown connected as an inverter. This high on line 263 passes through nor gate 264 to produce a low on line 265 (see FIG. 5). Line 265 (see bottom of FIG. 3) passes to npn transistor 112 producing the low at the junction which low disables the memory through blocking of current flow at the transistor.

At the same time, the machine is either in a soak cycle or in a cleaning cycle, it is required that both the push button enable circuitry 143 (FIG. 5) and the coin accepting mechanisms (FIG. 6) 70B, 72B be disabled.

Regarding the coin circuitry, it will be remembered, that while the copier is in the cleaning cycle or a soak cycle, the ready circuit (107 of FIG. 3) will not be energized. Accordingly, circuit 107 will be low through output 270 to nor gate 272 providing there has not been a misfeed at misfeed latch 128 (see FIGS. 3 and 4). The output of nor gate 272 to inverting nand gate 273 will be a high. This high will be inverted by nand gate 273 to a low. The three-way nand gate 138 will see that the copier is not ready. Consequently, it will output a high at output 275.

Referring to FIG. 6, the high at output at 275 will place a low through nor gate 237. NPN transistor 238 will be blocked and power through limiting resistors will be extinguished. The coin receipt slot will be disabled.

Blocking of the push button to enable circuitry can likewise be followed. Referring back to FIG. 5, the logical high on line 275 will pass through nor gate 276 placing a low on line 277. This low on nand gate 278 will place a high on line 279. This high will invert to a low at nor gate 280. As can be seen, the low from nor gate 280 will block respective nand gates 281, 282. As will hereinafter be apparent, with these nand gates blocked it is not possible for a signal for copy reproduction of either variety to be received.

Returning to FIG. 4, in response to the high produced at the output of nand gate 135, resetting of the soak cycle and start timer 131 as well as the abort cycle, pump and feed time out dividers 133 will occur. Specifically, the high at line 200 will pass through respective nor gate 290 to nand gate 292 where a resultant high will reset timers 131 and 132. Reset of the copier start latch 130 will likewise occur.

At the same time, the logical high will additionally pass through nor gate 293 to limiting transistor 294. Transistor 294 will block and disable pump through optoisolator 86B, and reset timer 133. The low will thence pass to nor gate 295 from where resetting of divider 133 will occur at a logical high. This logical high will pass to lines 296 through respective nor gates 297 and 298 disabling both the 11 inch feed optoisolator 82B and the 14 inch feed optoisolator 84B.

Schmidt triggered nand 135 will generate a high for a short period of time. Thereafter, a low will be seen on line 200.

When the soak cycle has run for approximately nine minutes, 12 seconds, divider 131 will output a high on each of the three inputs of nand gate 300. A low will be produced on line 301 to nand gate 302. A resetting of the soak cycle latch 132 will occur through a high generated on output 303.

During the period of time that the copier can operate in the soak cycle mode, one difficulty can occur. Specifically, and assuming that the copier had a misfeed (for example a jammed piece of paper) before the power was interrupted, misfeed latch 128 will be in a misfeed state. This will occur through nand gate 310 which will generate a high on line 311 at nor gate 272. The input high will be passed as a low inverted at nand gate 273 as a low to the wait gate 138. The result will be that this gate will remain high on line 275 inhibiting copier function of any kind including the reception of coins.

At the same time, it is necessary to keep the drum motor from moving. Note that in a misfeed condition, movement of the delicate selenium drum against jammed paper could cause damage.

When the misfeed latch is set through a machine misfeed, a logical high will be present on line 320 from misfeed latch 128 (see FIG. 3). Line 320 with its high (see bottom FIG. 6) passes to nor gate 321 where the high is inverted to a logical low at output 322 at nand gate 324 (see FIG. 6) a high will be produced illuminating the sign sold out at 172.

It will be recognized that when the copier is in the misfeed state, its own internal logic will prevent drum rotation and even a standard machine cleaning cycle. However, it is necesssary to inhibit the machine receipt of coin. Accordingly, a high at misfeed latch 128 on line 600 (FIG. 3 and then FIG. 4) causes nand gate 351 to go low. Wait gate 138 passes a high to line 275 with the result that coin receipt if blocked.

Assuming that power has been connected for a period of 24 hours, with no machine use occurring in a like period, a conventional machine cleaning cycle will be initiated. Specifically, divider 132 will output highs to nand gate 605. A resultant low on one terminal of nand gate 292 will output a high. This high will reset dividers 131, 132 and activate start latch 130. The copier will cycle through its cleaning cycle. Due to the fact that no paper is introduced and the soak cycle is not called for, in the absence of a misfeed a conventional cleaning cycle will occur.

When the soak cycle is completed, and soak cycle latch 132 is reset, a high will be produced on line 202 (see FIG. 3). As a result, the drum motor 60 will be enabled. Standard function of the Savin copier in the cleaning cycle mode will continue.

When the Savin copier is finished with the cleaning cycle, the Savin ready terminal 107 will go high. The logical high will pass through line 272 to nor gate 272 (see FIG. 4). The output from nor gate 272 will be inverted at inverting nand gate 273 to a high. The result will be a high seen at the middle input to wait gate 138.

It is necessary that the inputs to the gate 138 all be high before an enabling low will pass to output line 275. Tracing of the other branches of the wait gate can be instructive.

Presuming, the reservoir has run low on dispersent output 102 (see FIG. 3) will go high at line 350. This will pass to nand gate 351 where in combination with other highs at that gate, the output at 352 will go low. The wait gate 138 will not pass an enabling signal.

At the same time, the low on line 352 will pass through nor gate 293 in combination with the other low at this gate, a high will output and a dispersent pump will turn on through optoisolator 86B.

When the dispersent supply is replenished, terminal 102 (see FIG. 3) will go low. The low produced on line 350 will pass to nand gate 351 which will cause the output 352 to go high.

Returning to FIG. 6, it will be remembered that the output of nand gate 230 was low when the circuit wasn't ready for the receipt of the coin. Accordingly, line 232 (see FIG. 6), FIG. 5 and then FIG. 4, nore gate 260 will cause nor gate 260 to pass a high to the wait gate 138.

When wait gate sees that the dispersent pump is not running, the copier is in readiness, and that the circuitry is ready to receive the coin, a logical low will be passed to line 275. Line 275 will through nor gate 237 (see FIG. 6) pass a high, which high will enable to receive coin and indicate that exact change is required (if applicable).

Having placed the copier in a state ready for coin operated function, coin operated function may now be reviewed.

Specifically, coin mechanism 60, upon the receipt of a coin, will indicate through optoisolator 74B that a vend is required. Line input 400 to the Schmidt triggered nand 401 will go low. Line 402 will output to vend latch 160 indicating that a vend is now required.

At the same time, through nand gate 404, the produced high in combination with the low on line 405 of the vend latch will output a low to nand gate 236. This low will invert to a high at nor gate 237 with a consequent low at transistor 238. Extinguishment of the coin receiving mechanism at optoisolators 70B and 72B will occur. The machine when it is ready to vend will not indicate that coin is required at terminals 170, 171.

Upon being ready to vend, it will be remembered that line 405 from the vend latch will be low. At the same time, output of nand gate 262 is low, indicating that the machine was in readiness. The consequent output of a select copy size latch 407 will be high. This high on line 409 will accomplish two things. First, it will illuminate the display select copy size. Secondly, it will enable the push bottom disable 143.

Regarding the enabling of the copy size selection circuit, the high on output 409 from select copy size nand gate 407 will pass to nand gate 278 (FIG. 5). At nand gate 278, the high will invert to a low at line 279, enter nor gate 280 and cause inputs to nand gate 282 and 281 to go low.

This will permit the vend signal to enable either a vend of 11" or 14" copy.

Regarding the illumination of the signs "Select Copy Size", the high on output 409 from select copy size nand gate 407 will pass to nand gate 278 (FIG. 5). At nand gate 278, the high will invert to a low at line 279, enter nor gate 280 and cause inputs to nand gates 282 and 281 to go high.

The low on line 279 will pass through an inverter nand 410 (see FIG. 6) which will illuminate the select copy size.

When the push button disable is enabled by a high appearing at line 211 (see FIG. 5) the copy size may be selected. Assuming that both copy sizes are available, the operator of the machine can depress circuitry (see FIG. 7) causing alternately outputs 181, 11 inch selection, or output 182, 12 inch selection, to go high (see FIG. 3). Assuming that the 11 inch selection is made, line 450 will go high. Going high, nand gate 281 will see a high of two of its three terminals.

Regarding the third terminal going highs, it will be remembered that with respect to the 11 inch size, it may be that the tray motor 39 is in operation. If tray motor 39 is in operation in either the up or the down mode, input to the remaining third gate of nand gate 281 will be low. This will be caused by either of the optoisolators 278B or 280B opening a path to ground causing line 452 to go low.

Assuming that lift motor is not in operation, a high input into nand gate 281 will result and actuation of copy can now occur.

When line 450 goes high, time delay circuitry 144 opened push button disable causing three highs to appear across nand gate 281. The output is a low, which low passes through nor gate 457 to 11 inch latch 141. The output at latch 141 on line 460 will be low, which low will pass through nor gate 297. Transistor 462 will open commencing feed motor 82B to feed the selected copy size of 11 inch.

Conversely and through similar logic, 14 inch feed motor can be activated. Specifically, pushing of the 14 inch copy size touch plate will pass through the delay circuitry 144. This will cause nand gate 282 to pass a low to nor gate 470. Nor gate 470 will invert to a high causing latch 142 to output a high on line 480. The high on line 480 will pass to nor gate 298, which gate will cause a low to appear. The resultant low will commence running of the 14 inch feed.

Having explained the vending function, the reader will remember that there are two main possibilities for malfunction when a feeding mechanism for a particular size of copy is in operation. The first of these is where the particular magazine is out of paper. If this is the case, the operator of the machine will be continually told by flashing indicia regardless of the vend status, that he cannot select one size but must select the other size of paper. The paper of the exhausted has its select button deactivated.

Secondly, where the feed motor runs for an inordinate period of time, paper must necessarily be jammed into the particular magazine calling for paper. If this is the case, again this paper must be indicated as unavailable and the machine operator directed to select an alternate size.

Assuming that 11 inch paper was out, it will be remembered that the 11 inch out terminal 150 on FIG. 5 will go high. The 11 inch paper going high will come out on line 500. Line 500 pass through nor gate 501 producing a low, which low will pass to and be seen at nand gate 281. No signal for the dispensing of 11 inch paper may then occur.

It will be remembered that it will be necessary where the 11 inch paper is out to tell the operator to select 14 inch paper only. Assuming that 14 inch paper is available, the high on line 500 will pass through nand gate 510 illuminating terminal 175. Referring to FIG. 7 it will be remembered that terminal 175 will cause the "14 inch Copies Only" sign to flash.

Assuming that both microswitches indicate the non-availability of paper, both nand gates 510, 511 will pass respective highs. These highs at circuitry on lines 512, 514 will pass a low through nand gate 515. This low will be inverted to a high at nor gate 516. Commencing with nand gate 321, a misfeed sequence will commence with "Sold Out" being indicated as previously described.

Taking the case where the feed motor runs for an inordinate period of time, divider 133 (see FIG. 4) will output a high on line 520. This high on line 520 will pass through an inverting nand gate 521 to produce a low on line 522. This will pass to nand gate 523 causing the respective 11 inch latch 141 or 14 inch latch 142 (whichever has been set for a vend) to reset.

Assuming that the 11 inch latch was set for a vend, an output from 11 inch latch 141 on line 525 of a high will pass to the 11 inch fault latch 139. The fault latch 139 will produce a high on line 526, which high will pass through nand gate 510. As previously explained, the non-availability of 11 inch paper will be indicated at terminal 175 (FIG. 6). Thereafter, the 14 inch only sign in FIG. 7 at 175A will be displayed.

Once the 11 inch fault latch is tripped, paper will not be available. Assuming that some while later the feed motor for the 14 inch paper runs for too lengthy a period of time, a similar process will result. Specifically and referring to FIG. 4, an input of 535 will trigger the fault latch to put out a high of 536. This high will pass to nand gate 511 (see FIG. 5). At nand gate 511, the resultant signal will indicate to nand gate 515 that neither paper size is available. Once neither paper size is available, a low from gate 515 will invert at nor gate 516 indicating a high at nor gate 321. High at nor gate 321 will indicate the machine has been sold out as previously described.

Having set forth the dual fault function for both magazines, a normal copy cycle may now be described.

Presuming that copy is dispensed, it will hit microswitch 50 (see FIG. 1). At microswitch 50 (terminal 151 on FIG. 5) a low signal will be produced. The low will be inverted at a Schmidt triggered nand 550. Output to line 551 of a high will pass through a Schmidt triggered nand 552 causing the upper gate of wait gate 138 to go low. Corresponding circuitry previously explained with not permit coins to be accepted.

Referring to FIG. 4, line 551 and the resultant high there produced will be inverted at nor gate 560, reinverted at nor gate 561 and inverted at nor gate 562. From 562, resetting of divider 133 will occur through nor gate 295. At the same time, through line 296, the respective feed motor will be turned off through either of nor gates 297, 298. Copy will occur with the copier indicating at gate 138 when it is ready.

If paper is stuck on microswitch 50, and for some reason the copier times out, when power is resupplied, a "SOLD OUT" will be indicated. The key operator may override the "SOLD OUT" and allow a copy to be made should visual inspection indicate that the paper is substantially undeformed and therefore safe to pass through the copier.

It will be understood that the logic here disclosed consists entirely of analog circuitry. It goes without saying that other forms of logic cooperating with the disclosed mechanism can perform the same result.

What is claimed is:

1. A copy machine having a connection to a power source, a rotating drum including a photosensitive surface for receiving thereon an electrostatic image of a copy, a motor for rotating said drum upon the receipt of power from said power source, an applicator registered to said drum for supplying toner and dispersant, a toner and dispersant reservoir, and a pump connected to said power source having a suction to said toner and dispersant reservoir and an output to said applicator, apparatus for maintaining said applicator and drum in a state of readiness for the production of copy from said copy machine, said apparatus comprising:

means for sensing the interruption of power connected with said power source, said means for sensing having an output;

means for inhibiting rotation of said drum responsive to said output whereby pumping from said reservoir to said applicator without drum rotation occurs upon interruption of the power;

first timing means for restoring drum rotation at the end of a preselected period of time whereby rotation of said drum occurs only against a toner and dispersant saturated applicator registered to said drum to prevent scarring of said drum on machine start-up;

second timing means having a second output;

said output of said second timing means operatively connected to said rotating drum to commence timing upon stopping of rotation of said drum;

means connected to said motor for rotating said drum to cause periodic rotation of said drum and pumping of toner to said applicator upon a signal from the output of said second timing means.

2. The invention of claim 1 and including a coin-vend mechanism connected to said copy machine to cause said machine to vend upon a coin being received and retained in said coin mechanism; and means operatively connected to said first and second timing means to prevent coin retention during said period of inhibited drum rotation and during said periodic rotation of said drum upon a signal from the output of said second timing means.

3. A copy machine having a connection to a power source; a rotating drum including a photosensitive surface for receiving thereon an electrostatic image of a copy; imaging means for imaging from a copy to a rotating drum an electrostatic image of a copy; a motor for rotating said drum upon the receipt of power from said power source; an applicator registered to said drum for supplying toner and dispersant to said drum; a first toner and dispersant reservoir; a pump connected to said power source having a suction to said toner and dispersant reservoir and having an output to said toner and dispersant applicator; coin receipt means for retaining a coin and emanating a first signal, said coin receipt means including means for inhibiting the retention of a coin upon receipt of at least a second signal; means for interrupting drum rotation upon the interruption of power at said power source; and indicia means for displaying a wait indicia upon the receipt of a second signal; vend indicia upon receipt of a first signal; and sold out indicia in response to the receipt of a third signal; means operatively connected to said means for interrupting drum rotation for emitting a second signal for displaying said wait indicia when said drum rotation interrupting means is actuated whereby coin retention is inhibited; a second reservoir containing at least dispersant; a second pump connected to said power source having a suction at said second reservoir and an output at said first reservoir; a level indicator on said first reservoir operably connected to stop and start said second pump responsive to the level in said first reservoir; a second timing means for timing the interval at which said second pump means operates against a preselected interval; means for emitting said third signal when said second pump means operates in excess of said interval.

4. A copy machine having a connection to a power source; a rotating drum including a photosensitive surface for retaining thereon an electrostatic image of a copy; imaging means for imaging from a copy to said rotating drum, said electrostatic image of a copy; a motor for rotating said drum upon the receipt of power from said power source; an applicator registered to said drum for supplying toner and dispersant to said drum; a first toner and dispersant reservoir; a pump connected to said power source having a suction to said toner and dispersant reservoir and an output to said toner and dispersant applicator, a second reservoir containing at least dispersant; a second pump connected to said power source having a suction at said second reservoir and an output at said first reservoir; a level indicator on said first reservoir operably connected to stop and start said second pump responsive to the level in said first reservoir; a second timing means for timing the interval at which said second pump means operates against a preselected interval; means for emitting a signal when said second pump means operates in excess of the interval of said timer and means for interrupting drum rotation upon reception of said signal.

* * * * *